US010717556B2

(12) United States Patent
Brunschwiler et al.

(10) Patent No.: US 10,717,556 B2
(45) Date of Patent: Jul. 21, 2020

(54) METHOD FOR PRODUCING COLLECTIONS OF PRINTED PRODUCTS, AND DEVICE FOR CARRYING OUT SAID METHOD

(71) Applicant: Ferag AG, Hinwil (CH)

(72) Inventors: Othmar Brunschwiler, Bettwiesen (CH); Roland Lengweiler, Gossau (CH)

(73) Assignee: FERAG AG, Hinwil (CH)

( * ) Notice: Subject to any disclaimer, the term of this patent is extended or adjusted under 35 U.S.C. 154(b) by 819 days.

(21) Appl. No.: 15/202,231

(22) Filed: Jul. 5, 2016

(65) Prior Publication Data

US 2016/0376043 A1 Dec. 29, 2016

(30) Foreign Application Priority Data

Jun. 24, 2015 (CH) ..... 910/15
Jun. 30, 2015 (CH) ..... 943/15
(Continued)

(51) Int. Cl.
*B65B 25/14* (2006.01)
*B65B 11/08* (2006.01)
(Continued)

(52) U.S. Cl.
CPC ..... *B65B 25/14* (2013.01); *B65B 11/08* (2013.01); *B65B 35/10* (2013.01); *B65B 41/16* (2013.01);
(Continued)

(58) Field of Classification Search
CPC ..... B65B 11/08; B65B 11/18; B65B 11/48; B65B 25/14; B65B 25/145; B65B 41/02;
(Continued)

(56) References Cited

U.S. PATENT DOCUMENTS 3,996,728 A 12/1976 Gentili
4,071,997 A * 2/1978 Gunther, Jr. ..... B43M 5/045 493/199
(Continued)

FOREIGN PATENT DOCUMENTS

DE 41 31 277 C1 3/1993
DE 197 25 605 A1 12/1998
(Continued)

OTHER PUBLICATIONS

Co-pending U.S. Patent Application, Brunschwiler, O., et al. "Method for Producing Collections of Printed Products, and Device for Carrying Out Said Methods," U.S. Appl. No. 15/202,252.

*Primary Examiner* — Andrew M Tecco
*Assistant Examiner* — Nicholas E Igbokwe
(74) *Attorney, Agent, or Firm* — Pauley Erickson & Kottis

(57) ABSTRACT

In a method for producing a collection of pre-products by wrapping a second pre-product around a first pre-product, it is provided according to the invention that said method comprises a number of steps. In one step, a first pre-product is provided, which has an edge region. In another step, a second pre-product is provided. In a further step, the second pre-product is conveyed into a wrapping position. In a further step, the first pre-product is conveyed, with the edge region in front, against the second pre-product located in the wrapping position, as a result of which a wrapping operation is initiated on the second pre-product.

31 Claims, 14 Drawing Sheets

(30) Foreign Application Priority Data

Jul. 21, 2015 (CH) ..... 1064/15
Jul. 21, 2015 (CH) ..... 1065/15

(51) Int. Cl.

| | |
|---|---|
| ***B65B 35/10*** | (2006.01) |
| ***B65B 41/12*** | (2006.01) |
| ***B65B 61/02*** | (2006.01) |
| ***B65H 45/30*** | (2006.01) |
| ***B65H 29/66*** | (2006.01) |
| ***B65H 45/28*** | (2006.01) |
| ***B65H 45/12*** | (2006.01) |
| ***B65H 45/22*** | (2006.01) |
| ***B65H 5/30*** | (2006.01) |
| ***B65H 29/12*** | (2006.01) |
| ***B65H 39/06*** | (2006.01) |
| ***B65B 41/16*** | (2006.01) |

(52) U.S. Cl.

CPC ..... *B65H 5/301* (2013.01); *B65H 29/12* (2013.01); *B65H 29/66* (2013.01); *B65H 39/06* (2013.01); *B65H 45/12* (2013.01); *B65H 45/22* (2013.01); *B65H 45/28* (2013.01); *B65H 45/30* (2013.01); *B65H 2301/3121* (2013.01); *B65H 2301/33214* (2013.01); *B65H 2301/33222* (2013.01); *B65H 2301/431711* (2013.01); *B65H 2301/5162* (2013.01); *B65H 2404/1113* (2013.01); *B65H 2404/1122* (2013.01); *B65H 2404/1411* (2013.01); *B65H 2404/2611* (2013.01); *B65H 2701/1932* (2013.01)

(58) Field of Classification Search

CPC ..... B65B 41/16; B65B 41/12; B65B 61/02; B43M 3/00; B43M 3/04; B43M 5/00; B43M 5/05; B65H 45/30; B65H 45/28; B65H 45/22; B65H 29/12

See application file for complete search history.

(56) References Cited

U.S. PATENT DOCUMENTS

| | | | | |
|---|---|---|---|---|
| 4,295,643 | A | 10/1981 | de la Vega | |
| 4,787,192 | A * | 11/1988 | Gunther, Jr. | B43M 3/04 271/110 |
| 5,082,255 | A | 1/1992 | Brigante et al. | |
| 5,125,214 | A * | 6/1992 | Orsinger | B43M 3/045 53/284.3 |
| 5,255,498 | A * | 10/1993 | Hotchkiss | B43M 3/045 53/258 |
| 6,164,046 | A * | 12/2000 | Werner | B43M 3/045 53/284.3 |
| 6,371,902 | B1 * | 4/2002 | Bluemle | B31B 50/00 493/370 |
| 6,386,771 | B2 * | 5/2002 | Haller | B43M 5/04 101/484 |
| 2003/0167736 | A1 | 9/2003 | Cinotti | |
| 2007/0164496 | A1 * | 7/2007 | Kapturowski | B43M 3/04 270/52.01 |
| 2011/0109032 | A1 | 5/2011 | Keller | |
| 2013/0104498 | A1 * | 5/2013 | Naitou | B65B 11/48 53/206 |
| 2013/0333333 | A1 * | 12/2013 | Batzer | B43M 3/04 53/473 |

FOREIGN PATENT DOCUMENTS

| | | | |
|---|---|---|---|
| EP | 0 493 109 | A1 | 7/1992 |
| EP | 0 515 320 | A1 | 11/1992 |
| EP | 0 629 551 | A1 | 12/1994 |
| EP | 0 952 006 | A2 | 10/1999 |
| EP | 1 227 040 | A1 | 7/2002 |
| EP | 1 371 561 | A1 | 12/2003 |
| EP | 2 316 661 | A1 | 5/2011 |
| EP | 2 462 043 | A | 6/2012 |
| EP | 2 955 138 | A2 | 12/2015 |
| GB | 831628 | | 3/1960 |
| WO | WO 03/008273 | A1 | 1/2003 |
| WO | WO 2008/074325 | A1 | 6/2008 |
| WO | WO2011/014968 | A1 | 2/2011 |
| WO | WO 2012/084494 | A2 | 6/2012 |

* cited by examiner

METHOD FOR PRODUCING COLLECTIONS OF PRINTED PRODUCTS, AND DEVICE FOR CARRYING OUT SAID METHOD

CROSS-REFERENCE TO RELATED APPLICATIONS

Swiss Patent Application 00910/15, filed 24 Jun. 2015, Swiss Patent Application 00943/15, filed 30 Jun. 2015, Swiss Patent Application 01064/15, filed 21 Jul. 2015 and Swiss Patent Application 01065/15, filed 21 Jul. 2015, the priority documents corresponding to this invention, to which a foreign priority benefit is claimed under Title 35, United States Code, Section 119, and their entire teachings are incorporated, by reference, into this specification.

BACKGROUND OF THE INVENTION

Field of the Invention

The invention relates to the field of further processing pre-products (particularly printed products in the context of print finishing). It relates to a method and a device for producing collections of printed products.

The invention also relates to a device for carrying out the method.

Discussion of Related Art

The term "direct mailing" has long been used to describe activities in which advertising pamphlets, brochures, flyers, printed sheets, product samples and the like, which usually were often enclosed (inserted) in a newspaper or magazine as enclosures for advertising purposes, are collected from several advertisers in order to make therefrom a large number of collections which each contain a printed product from a plurality of advertisers and are delivered and distributed to the recipients (for example households) in the form of a small stack.

In order to be able to better handle the individual stack-like collections of printed products during transport and distribution, it is advantageous to take measures to hold together the individual stacks.

Methods and devices for holding together stacked printed products or related products by wrapping with other holding-together elements are known from the prior art.

EP 0952006 A2 discloses a method for fabricating printed letters, an envelope, a device for fabricating the envelope as well as a method for fabricating the envelope. The application discloses the packaging of printed letters by way of a full envelope comprising a single sheet of paper or plastic which is specially cut as a packaging means, that is to say a specific packaging product. To this end, such a single sheet is said to be cut by means of a cutting unit and then folded, wherein tabs folded at fold edges can be bonded to one another by an application of adhesive.

DE 41 31 277 C1 discloses a method and a device suitable therefor, by which an object to be packaged can be united with a special packaging blank. A device is disclosed in which an object to be packaged passes from a first feeding device to a second feeding device. The second feeding device has a lower belt which is guided on one side over a roller. By virtue of a pressing device, which has a pressing roller and a guide element, a deflection of the packaging blank at the roller is intended to take place in order to guide the packaging blank in different ways onto the object to be packaged. In order to pass from the first to the second feeding device, the disclosed objects to be packaged must have a relatively high structural stiffness.

WO 2012/084494 A2 discloses a method for assembling a stack of pre-products resting loosely one on top of the other, the composition of such pre-products and a device for producing such compositions. To this end, the stack to be assembled is provided in a first step, said stack consisting of pre-products resting loosely one on top of the other, and in a second step a connecting element is fitted on an edge of the stack such that said element overlaps the two outer pre-products of the stack in an adhesive manner. This method offers reliable assembly for many applications, but requires special connecting elements which are glued.

The European patent application No. 15001321.7, which was not published before the present application, was filed on 5 May 2015 in the name of Ferag AG and discloses a device for producing collections composed of a plurality of different printed products. Some of the printed products are in each case used as a packaging element, into which the other printed products are inserted. In this way, graspable units can be produced which can easily by removed by hand from a transport container by a distributor. In contrast to previously known methods for producing such collections, in this method no special additional packaging means are required, such as films or tapes. As a result, the costs of producing collections can be lowered and the amount of waste created can be reduced. Said patent application discloses a number of methods and devices for producing such collections. One embodiment of a wrapping device suitable for this purpose has a brush roller with bristles bent in the direction of rotation, which bends upward approximately at right angles at a section of a packaging element which has been placed beforehand partially below an intermediate stack (for example of printed documents). In a subsequent step, this packaging section is bent back over the intermediate stack as soon as the packaging element and the intermediate stack enter the intermediate space between two transport belts. Such a wrapping device is suitable for a particular group of wrapping products and intermediate stacks, but under some circumstances may be difficult to control in the case of relatively thin and flexible intermediate stacks in combination with thick and stiff wrappings. Another wrapping device disclosed in the aforementioned application has rod-shaped entraining elements which are rotated about an axis of rotation oriented transversely to the movement direction of the unit consisting of an intermediate stack and packaging element. These entraining elements additionally perform an oscillating movement transversely to the conveying direction, for which a relatively complicated and/or maintenance-intensive mechanism or control system may be required.

WO 2008/074325 A1 discloses a method for wrapping a stack of sheets, brochures or the like, in which the stacks are transported at a distance one behind the other on a transport path. By means of a special swivel wheel, one wrapping sheet is pulled from a provided supply of sheets and is positioned vertically in a gap between two successive stacks. The swivel wheel then provides means which fold the sheet around the stack moving past. The complicated movement of the swivel wheel prevents a high processing speed of the stacks.

SUMMARY OF THE INVENTION

It is therefore an object of the invention to provide a method which enables first pre-products to be wrapped by second pre-products, which method is suitable for many different combinations of pre-products and can be reliably carried out using devices which are relatively simple in comparison to the solutions known from the prior art.

Another object of the invention is to provide a device by which such a method can be carried out.

These and other objects are achieved by claims 1 and 15. Embodiments of the invention will become apparent from the dependent claims.

One embodiment of a method for producing a collection of pre-products by wrapping a second pre-product around a first pre-product according to the invention is characterized by the following steps:

providing a first pre-product, which has an edge region;

providing a second pre-product;

conveying the second pre-product into a wrapping position;

conveying the first pre-product, with the edge region in front, against the second pre-product located in the wrapping position, as a result of which a wrapping operation is initiated on the second pre-product.

In one embodiment of the method, the second pre-product is not a typical, specially provided packaging means (such as for example a film or a special paper sheet), as will be explained in greater detail below. In one embodiment of the method, the second and first pre-products may be identical, as a result of which, in contrast to the methods known from the prior art, the second pre-product is not a special or specific packaging product.

If necessary, the second pre-product may comprise a printed product which has a fold, a stapling or a binding.

In one embodiment of the method, the second pre-product comprises a printed product which has a fold, a stapling or a binding, wherein the fold (or the stapling or the binding) in the wrapping position is oriented substantially perpendicular to the edge region of the first pre-product. In this way, it is possible inter alia to prevent the situation whereby the plies of a wrapped-around multi-ply second pre-product shift relative to one another when gripped by hand.

In another embodiment of the method, the second pre-product comprises a printed product which has a fold, a stapling or a binding, wherein the fold (or the stapling or the binding) in the wrapping position is oriented substantially parallel to the edge region of the first pre-product. In this way, it is possible to avoid bumps or kinks in the fold, the stapling or the binding.

For certain applications, according to one embodiment of the method, the second pre-product is provided as a section of a paper or film web (hereinafter also referred to as "web").

In one embodiment of the method, the web is a single-ply web.

In another embodiment of the method, the web is a multi-ply web, in particular a folded and/or creased web.

For certain applications, the paper or film web may be unwound from a roll.

In one embodiment of the method, the paper or film web is processed between the roll and the site at which the second pre-product is located in the wrapping position.

In one embodiment of the method, the web is printed using a printing machine and is wound onto a roll. The web is then unwound again from the roll and a second pre-product is provided as a section of the web.

According to another embodiment of the method, the web is printed using a printing machine and a second pre-product is provided as a section of said web, without the web being wound onto a roll in the interim.

In one embodiment of a method, the second pre-product is cut from the web before being conveyed into the wrapping position. As a result, second pre-products can be conveyed at particularly high speeds into the wrapping position and thus the cycle times can be shortened.

In another embodiment of a method, the second pre-product is cut from the web after being conveyed into the wrapping position. In this way, the conveying and orienting of the second pre-product can be simplified.

Particularly good results can be achieved if the web, prior to being cut, is intermediately stored in a buffer, for example a loop buffer. On the one hand, particularly clean cut edges can be achieved as a result. On the other hand, the cutting process, and/or the device necessary therefor, can in this way be simplified.

According to one embodiment of a method according to the invention, the web is printed using a digital printing machine. By using a digital printing machine, it is possible if necessary to produce a web comprising sections of different second pre-products. In this way, for example, collections with individualized wrappings can easily be produced.

In one embodiment of such a method, the second pre-products may be personalized advertising products, the content of which is aimed at a particular recipient or a particular group of recipients. As an alternative or in addition, such a second pre-product may also include a personal addressing to a recipient or to a group of recipients. A group of recipients may be formed, for example, of the inhabitants of a geographic region, a town, a village or a district or a building.

The first and the second pre-product may be for example a collection of single-ply or multi-ply printed products of identical or different size resting loosely one on top of the other. If required, individual or multiple product samples may be arranged on, below or between the printed products. The first and/or the second pre-product may also be for example individual products, such as for instance individual printed products.

The edge region may be for example a region of a leading edge of the first pre-product. If the first pre-product comprises a plurality of printed products, at least some of these printed products may be arranged in such a way that they have a preferred edge and the preferred edges jointly form the edge region.

A particularly reliable and robust method is obtained if the first pre-product is conveyed, at least with a sub-area resting on a conveyor table, against the second pre-product located in the wrapping position.

Such a conveyor table may in this case at least aid the conveying of the first pre-product against the second pre-product located in the wrapping position, by supporting said first pre-product so that it retains its shape.

However, the conveyor table may also be configured in such a way that it aids the initiation of the wrapping operation or itself initiates the latter, as will be explained in greater detail below. In this case, the conveyor table may for example hold and/or guide and/or accompany the first pre-product.

A wrapping operation which is particularly easy to control can be achieved if the conveyor table actively aids the wrapping operation. To this end, the conveyor table may for example press with one edge against the second pre-product located in the wrapping position, thereby deforming the latter. As a result, it becomes possible inter alia to bring together many combinations of first and second pre-products of different dimensions, weights and stiffnesses to form collections, without the method or a device carrying out said method having to be significantly adapted to the type of pre-products. The complexity needed for changeover operations can thus be minimized, as a result of which production downtimes can be reduced.

According to one embodiment of the method according to the invention, the first pre-product comprises a stack of individual printed products. Such printed products may be for example advertising pamphlets, brochures, magazines, flyers or printed sheets. However, such a stack may also contain further printed products, such as product samples for example. In comparison to the methods known from the prior art, the method according to the invention enables the processing of stacks which consist of a plurality of printed products or other articles with greatly differing dimensions. Stacks formed of such articles often have neither a regular quadrangular shape nor precisely known mechanical properties, which makes it impossible for these to be processed by many methods known from the prior art.

Good results can be achieved if the first pre-product comprises a plurality of printed products which have a preferred edge and the printed products are arranged in a stacked manner in such a way that their preferred edges jointly form a stack edge which represents the edge region. In the case of collections produced by such an embodiment of the method, the individual printed products are secured particularly well against slipping out of the collection when the collection is gripped by hand.

Collections which can be gripped particularly well by hand can be achieved if at least some of the individual printed products have a fold, a stapling or a binding and are placed one on top of the other in such a way that the folds or bindings form the edge region around which the second pre-product is wrapped. In this way, it is possible inter alia to reduce the risk that individual printed products will fall out of the collection when the collection is gripped by hand. A folded and/or stapled and/or glued edge may also be referred to as the spine. In another embodiment of this method, some of the printed products are to be arranged with their spine on the side located opposite the edge region, in order to achieve a more uniform thickness of the first pre-product.

In a further embodiment of the method, the preferred edges of the printed products can be assumed to be those edges which are arranged on the side opposite the spine. Such an edge may also be referred to as the flower. If some or all printed products of the first pre-product have such a flower, these printed products may be stacked with the flowers one above the other or one on top of the other so that the edge region is formed of the flowers. In another embodiment of this method, some of the printed products are to be arranged with the flower on the side opposite the edge region, in order to achieve a more uniform thickness of the first pre-product.

In a further embodiment of the method, at least some of the printed products have spines and are arranged in a stacked manner in such a way that the spines jointly form a stack edge which is arranged on the side of the first pre-product opposite the edge region, as will be explained in greater detail below. Such an embodiment of the method may be advantageous for example if the first pre-product comprises printed products of different dimensions, since the thickness of the edge region can thus be reduced, thereby favoring the wrapping of the first pre-product.

In a further embodiment of the method, at least some of the printed products have flowers and are arranged in a stacked manner in such a way that the flowers jointly form a stack edge which is arranged on the side of the first pre-product opposite the edge region.

According to one embodiment of the invention, in an upstream method step, N individual printed products are provided, wherein the first pre-product is formed of N−x (x=1, 2, 3 . . . ) of the N individual printed products and the second pre-product is formed of the x remaining individual printed products. As a result, the costs per collection produced can be lowered and waste arising from packaging materials can additionally be avoided. In such an embodiment, the first pre-products and second pre-products are therefore identical, whereby the second pre-products are not special or specific packaging means.

In particular, in one embodiment of the method according to the invention, it is possible that x=1. By virtue of certain embodiments of the invention which will be explained in greater detail below, it is also possible that the wrapped-around second pre-product may be thicker and/or stiffer than the first pre-product, without the wrapping operation becoming difficult to control as a result, as is sometimes the case in the methods known from the prior art.

Particularly cleanly wrapped collections can be achieved if, after the initiation of the wrapping operation, the first pre-product and the second pre-product are moved through a pressing-together device, in which a first sub-area of an outer surface of the second pre-product and a first side of the first pre-product and a second sub-area of the outer surface of the second pre-product and a second side of the first pre-product are pressed against one another.

A particularly well-defined wrapping can be achieved if the second pre-product, at the time of initiation of the wrapping operation and/or during the subsequent wrapping operation, is temporarily clamped in a first and a second clamping region so that the edge region of the first pre-product lies between the first and second clamping region at the time of initiation of the wrapping operation or respectively during the wrapping operation, as will be explained in greater detail below.

In this way, the second pre-product can be positioned in a particularly precise manner relative to the first pre-product.

Undesired sliding of the second pre-product over the edge region of the first pre-product during wrapping can thus also be largely prevented if necessary.

In addition, a fold edge can also be formed in the second pre-product if necessary, particularly if an edge of a conveyor table lies in front of the edge region of the first pre-product at the time of initiation of the wrapping operation.

A further embodiment is characterized in that the first and the second sub-area are different, and therefore the second pre-product is not wrapped around in halves. If a collection produced in this way is placed flat with the larger sub-area upward, the weight of this larger sub-area prevents the wrapped-around second pre-product from unfolding again. In certain cases (if desired), further fastening means can thus be omitted.

The necessary ratio between first and second sub-area which prevents the second pre-product from unfolding again depends on a number of properties of the first and/or second pre-product, in particular on the stiffness and the weight of the second pre-product and the thickness of the first pre-product. In a further embodiment, the first sub-area is two-thirds (⅔) and the second sub-area is one-third (⅓) of the outer surface. It has been found that an unfolding of many collections of different first and second pre-products can be efficiently and robustly prevented by such a ratio between first and second sub-areas, and at the same time collections produced by such a method can also be comfortably and securely gripped by hand. Different collections can thus be produced on a device carrying out such an embodiment of a method, without the device having to be significantly adapted thereto in each case.

Another embodiment of the method according to the invention is characterized in that the first pre-product is conveyed in a conveying plane. As a result, particularly in the case of relatively thick and/or unstable first pre-products, conveying which is particularly gentle on the latter can be achieved.

A particularly advantageous wrapping-around of the second pre-product can be achieved if the first pre-product is conveyed in a conveying plane and the second pre-product, at the time of initiation of the wrapping operation, is oriented substantially perpendicular to the conveying plane of the first pre-product.

Depending on the nature of the second pre-product, it may be advantageous if the second pre-product is scored prior to the wrapping operation in order to facilitate the wrapping operation. Multiple scoring or imprinting is possible.

As an alternative or in addition, at least part of an outer surface of the second pre-product may be moistened prior to the wrapping operation in order to facilitate the wrapping operation.

A further embodiment of the method according to the invention is characterized in that, prior to the initiation of the wrapping operation, a glue is applied to one of the sub-areas of the second pre-product and/or to a surface of the first pre-product which is covered by one of the sub-areas after the wrapping. As a result, undesired unfolding of the wrapped-around second pre-product can be prevented, particularly in the case of relatively stiff second pre-products and/or relatively thick first pre-products.

According to a further embodiment of the method according to the invention, the second pre-product may be temporarily held in the wrapping position by a stop. By virtue of such an embodiment, the position of the wrapping site can be influenced and/or a synchronization between the conveying of the first and second pre-products can be simplified.

A device according to the invention for carrying out such a method generally comprises a first conveyor device for the second pre-product, which conveys the second pre-product into the wrapping position. Said device also comprises a second conveyor device for the first pre-product, which conveys the first pre-product, with an edge region in front, against the second pre-product located in the wrapping position in order to initiate the wrapping operation.

In one embodiment of the device according to the invention, the first conveyor device and the second conveyor device are synchronized with one another.

In order to reduce the spatial dimensions of a device according to the invention and/or to be better able to convey certain pre-products on curved sections and/or to reduce the speeds of the conveyor devices or respectively to increase the processing speed, the first and/or second pre-products may also be transported at least in some sections in an overlapping arrangement. Easy processing becomes possible if the pre-products are arranged in an overlapped manner in such a way that the leading pre-products lie over the trailing pre-products.

In one embodiment of the device according to the invention, the second conveyor device may comprise at least two transport sections which are located in one plane and between which an at least temporary conveyor gap is left free, in which the second pre-product is held in the wrapping position. Such an at least temporary conveyor gap may be for example a gap in a belt conveyor.

One embodiment of a device according to the invention is characterized in that the wrapping position extends through the at least temporary conveyor gap. In other words, the wrapping position of the second pre-product and the at least temporary conveyor gap are oriented relative to one another in such a way that the second pre-product located in the wrapping position is located at least partially in the at least temporary conveyor gap.

Particularly cleanly wrapped collections can be achieved if the device has a pressing-together device, in which a first sub-area of an outer surface of the second pre-product and a first side of the first pre-product and a second sub-area of the outer surface of the second pre-product and a second side of the first pre-product, located opposite the first side, are pressed against one another. If necessary, such a pressing-together device may also bring about a targeted compression of the collections to be produced.

A particularly simple type of pressing-together device can be achieved if the latter comprises a roller pair which adjoins the at least temporary conveyor gap and which conveys the first and second pre-product in a temporarily clamped manner, as will be explained in greater detail below. A pressing-together device may also comprise a plurality of such roller pairs.

A wrapping which is particularly gentle on the pre-products and also a use of said pressing-together device for a plurality of different pre-products can be achieved if the rollers of a roller pair are elastically deformable in the radial direction and/or the axes of rotation thereof can be reversibly pushed apart so as to exert a defined force. Such a device enables sequential processing of very different pre-products, without the device having to be readjusted or modified in each case.

In one embodiment of a device according to the invention, at least one roller of a roller pair is made of a foam rubber and/or has a plurality of relatively large internal cavities which reduce the stiffness of the roller in the radial direction.

In a further embodiment of a device according to the invention, at least one of the rollers of a roller pair has a radius which is variable in the circumferential direction, as will be explained in greater detail below. In this way, certain types of pre-products can be wrapped in a particularly gentle manner. For example, sub-areas of the second pre-product can be placed against the first pre-product only at certain locations, so as not to damage particularly sensitive printed products or product samples.

As an alternative or in addition, a device according to the invention may have a clamping device which, at the time of initiation of the wrapping operation and/or during the wrapping operation, temporarily clamps the second pre-product in a first and a second clamping region so that the edge region of the first pre-product is located between the first and second clamping region at the time of initiation of the wrapping operation or respectively during the wrapping operation, as will be explained in greater detail below.

According to one embodiment, the transport sections comprise belt conveyors. Such embodiments of the invention enable easy and reliable transport of many types of pre-products and collections.

In particular, the transport sections may each have belt conveyor systems formed of two belt conveyors arranged at a distance from one another perpendicular to the conveyor device, and the first and/or second pre-products are transported in a manner clamped between the belts of the two belt conveyors.

A particularly large number of combinations of first and second pre-products can be processed by an embodiment of a device in which the second conveyor device has a conveyor table which conveys the first pre-product, with an edge region in front, against the second pre-product located in the wrapping position in order to initiate the wrapping operation. Such a conveyor table may on the one hand support a first pre-product, as a result of which for example undesired lateral bending of the first pre-product in an at least temporary conveyor gap can be prevented. This is particularly advantageous if the first pre-products are conveyed in a substantially horizontal direction through an at least temporary conveyor gap. A conveyor table may also aid the initiation of the wrapping operation, as will be explained below. A device according to the invention may also have a plurality of conveyor tables. A conveyor table may be configured for example as a panel or as an assembly composed of multiple panels. As an alternative or in addition, a conveyor table may have a rod-shaped or bow-shaped structure.

Particularly for processing particularly sensitive pre-products, a conveyor table may have a surface with a particularly low static and/or sliding friction coefficient. As a result, relative movements between the pre-products and the conveyor table can be encouraged, as will be explained in greater detail below. To this end, certain regions which come into contact with the first and/or second pre-product may be made for example of polytetrafluoroethylene or materials having similarly good sliding properties.

In a further embodiment of a device according to the invention, a conveyor table may hold and convey a first pre-product at least at times in a clamped manner.

As an alternative or in addition, a conveyor table may grip and/or convey a first pre-product at least at times using a vacuum suction gripper.

In particular, a conveyor table may be connected to a drive which enables a recurring translational movement of the conveyor table in the conveying direction of the first pre-product.

A particularly simple drive, which, at the same time, is also synchronized with the second conveyor device, may be achieved for example if the second conveyor device comprises a belt conveyor and the conveyor table is operatively connected to the belt conveyor via a connecting rod mechanism.

A secure wrapping-around of very stiff or heavy second pre-products can be achieved if the conveyor table has an edge which aids the operation of wrapping around the second pre-product. Such an edge may be arranged in such a way that, during a wrapping operation, it presses against the second pre-product before the first pre-product and/or at the same time as the first pre-product and/or after the first pre-product. If the edge presses against the second pre-product before and/or at the same time as the first pre-product, even thin flexible first pre-products (for example individual sheets) can be processed, without these being folded or buckled or crushed during the wrapping operation.

In one embodiment of the device according to the invention, the edge is arranged relative to the first pre-product in such a way that the edge reaches the second pre-product considerably in advance and thus initiates the wrapping operation.

In particular, the device may be designed in such a way that the second pre-product is folded by a pressing-together device, while the first pre-product is arranged in a trailing manner relative to the fold. In this way, the second pre-product can be folded particularly cleanly. If desired, the first pre-product can be pushed further into the second (wrapped-around) pre-product after the folding has taken place.

Another embodiment of the device according to the invention is characterized in that the first conveyor device is assigned a stop which temporarily holds the second pre-product in the wrapping position, as will be explained in greater detail below. In this way, a precisely defined wrapping position, and thus also a wrapping result which is the same for all collections produced, can be ensured in a simple manner. If required, such a stop may also be movable or displaceable, whereby second pre-products can be held in different wrapping positions.

Particularly simple devices can be achieved if the second pre-product is held in a wrapping position which is substantially perpendicular relative to the conveying plane of the first conveyor device.

To prevent the wrapped-around second pre-products from unfolding again, a device according to the invention may have a glue application device which applies glue to the first and/or second pre-product prior to the initiation of the wrapping operation. Good results can be achieved for example using removable glues, for example as glue spots and/or glue lines.

A further embodiment of a device according to the invention is characterized in that said device has a moistening device for at least partially moistening the second pre-product prior to the initiation of the wrapping operation. By virtue of such moistening, the inherent stiffness of a second pre-product made of paper can be reduced in the region of the wrapping site, thereby aiding the wrapping operation. Such a moistening may take place for example via nozzles or at least partially wetted rollers or rolls.

As an alternative or in addition, the device may have a scoring device for scoring the second pre-product. By virtue of such a scoring device, one or more transverse scores (or imprints) can be made in the second pre-product for example before the latter is wrapped around, as a result of which the wrapping can be aided. If desired, a certain structure can also be formed in the second pre-product in the region of the wrapping edge, as a result of which a defined wrapping result can be achieved.

According to one embodiment of a device according to the invention, the first conveyor device is assigned means for providing a paper and/or film web (web).

A particularly space-saving device can be achieved if the latter has means for feeding a second pre-product which is wound onto a roll as a section of a web.

According to a further embodiment of a device according to the invention, the first conveyor device is assigned a cutting device for cutting the second pre-product from the paper or film web. This cutting device may be arranged in the conveying path of the first conveyor device and may be designed in such a way that it cuts the second pre-product from the paper web or a film web. In this way, the second pre-product can be fed to the device as a web. As a result, as already described, it is possible if necessary to produce for example individualized collections in a simple manner.

Good results can be achieved if the cutting device comprises a laser and/or a static blade and/or a rotating blade and/or a blade which is displaceable in the conveying direction of the second pre-product.

In order to improve the conveying of certain types of second pre-products, the cutting device in one embodiment of the method may be arranged in such a way that the second pre-product is cut from the paper or film web before said second pre-product is located in the conveyor gap.

As an alternative, a cutting device may be arranged in such a way that the second pre-product is cut from the paper or film web when said second pre-product is located at least partially in the conveyor gap. In this way, for certain second pre-products, a particularly precise conveying into the wrapping position can be achieved.

BRIEF DESCRIPTION OF THE DRAWINGS

The invention will be explained in greater detail below on the basis of exemplary embodiments and in connection with the drawing, in which.

DESCRIPTION OF PREFERRED EMBODIMENTS

Figure 1:
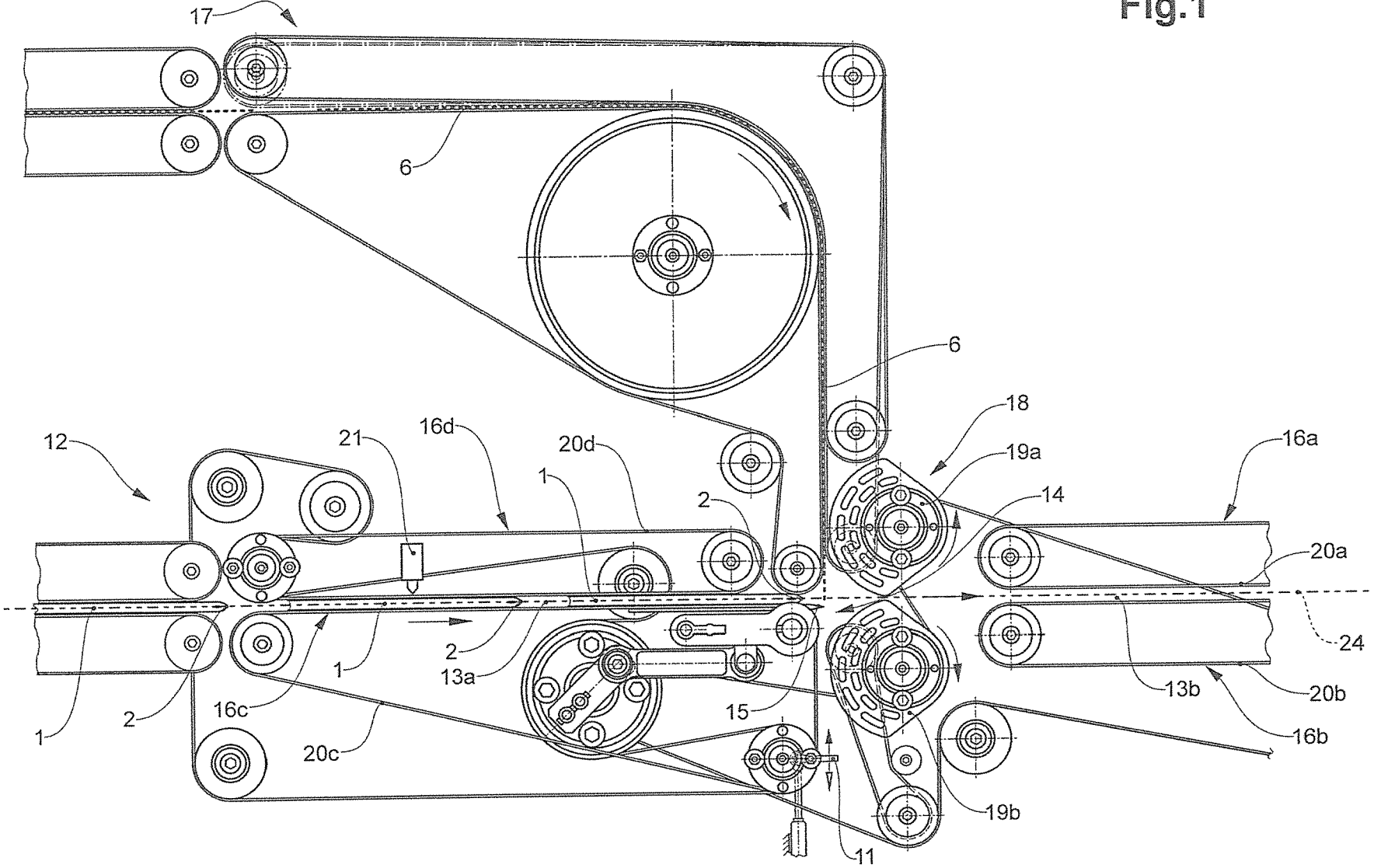
FIG. 1 shows, in a schematic side view, a first exemplary embodiment of a wrapping device during operation, at a first point in time.

FIGS. 1 to 7 show, in schematic diagrams, one embodiment of a device according to the invention for carrying out a method according to the invention, at different points in time during the method. In the device shown, second pre-products 6 (illustrated by broken lines) are conveyed individually one after the other in a first conveyor device 17. The first conveyor device 17 comprises a plurality of belt conveyor systems formed of belt conveyors arranged at a distance from one another, wherein the second pre-products 6 are transported in a manner clamped between the belts of the belt conveyors. The second pre-products 6 are brought via a curve from a horizontal conveying direction into a vertical conveying direction (schematically illustrated by a curved arrow). In the method shown, the illustrated second pre-products 6 are folded printed products, the fold of which is parallel to the conveying direction (not shown in detail).

In a second conveyor device 12, first pre-products 1 are likewise conveyed individually one after the other in a conveying plane 24. The first pre-products 1 are conveyed with an edge region 2 transverse to the conveying direction (schematically illustrated by an arrow). Like the first conveyor device 17, the second conveyor device 12 comprises a plurality of belt conveyor systems formed of belt conveyors 16*a-d* arranged at a distance from one another, wherein the first pre-products 1 are transported in a manner clamped between the belts 20*a-d* of the belt conveyors 16*a-d*. Located between a first transport section 13*a* formed of first belt conveyors 16*a*, 16*b* and a second transport section 13*b* formed of second belt conveyors 16*c*, 16*d* is an at least temporary conveyor gap 14, in which no continuous conveying of the first pre-products 1 takes place. Arranged in the region in front of the at least temporary conveyor gap 14 is a conveyor table 15 which in the illustrated embodiment adjoins the first transport section 13*a*.

Figure 2:
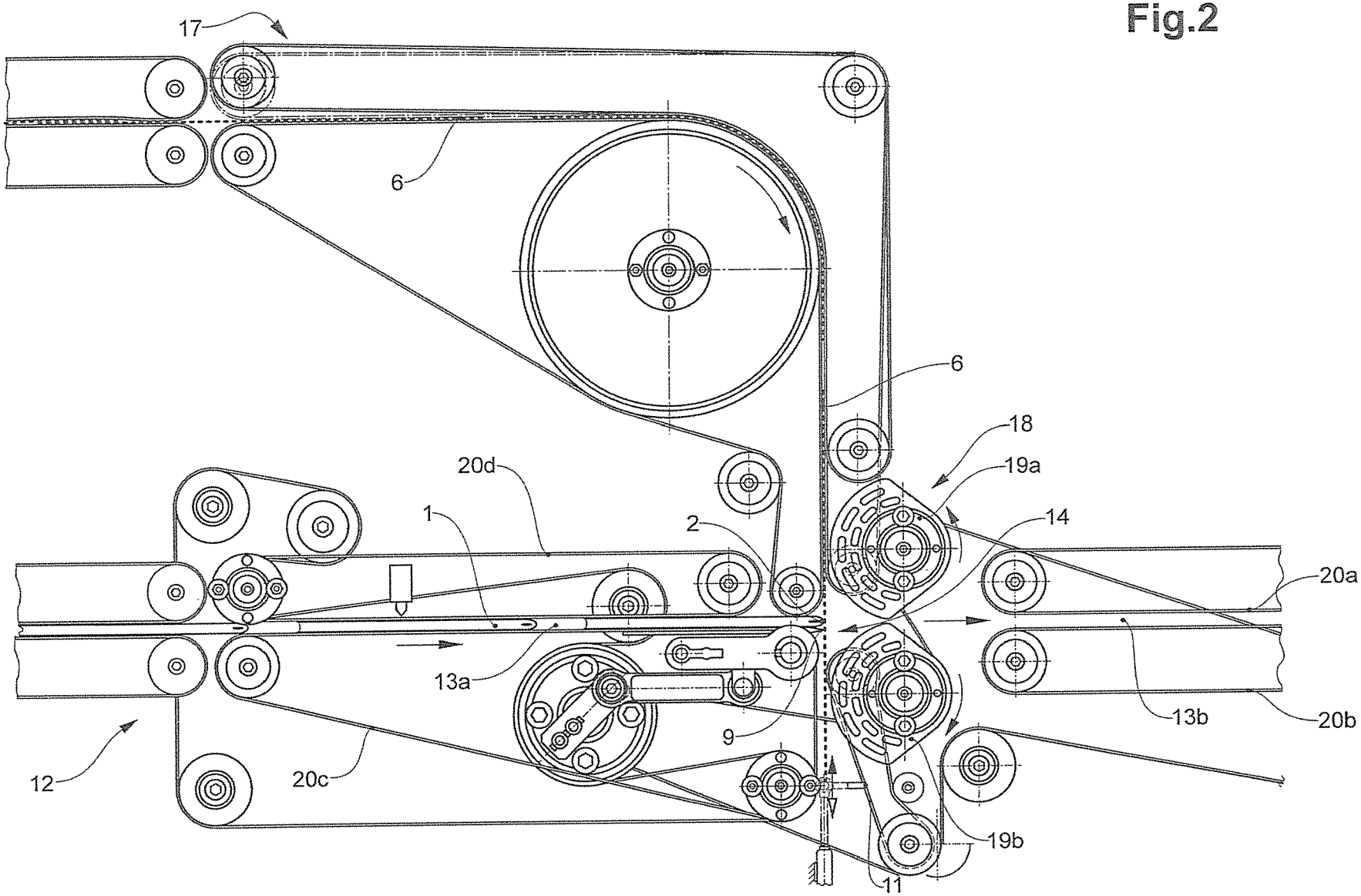
FIG. 2 shows the embodiment of a wrapping device shown in FIG. 1, during operation, at a second consecutive point in time, after the first.

In the method state shown in FIG. 1, the conveyor table 15 is located in a set-back state, so that the second pre-product 6 can be conveyed vertically downward through the at least temporary conveyor gap 14 into a wrapping position oriented substantially perpendicular to the conveying plane 24 of the first pre-product 1, said wrapping position being shown in FIG. 2. As illustrated in FIG. 2, the device has a stop 11 which limits the downward conveying of the second pre-product 6 and thus temporarily holds the second pre-product 6 in the wrapping position. The stop 11 is displaceable (illustrated by a double-headed arrow) along the conveying direction of the second pre-product 6, so that different wrapping positions can thus be set.

Also located in the region of the first transport section 13*a* is a glue application device 21 which if necessary can apply glue spots to the first pre-products 1.

The conveyor table 15 shown in FIGS. 1 to 7 has an edge 9 and is synchronized with the first and second conveyor sections 17, 12 in such a way that it carries out a translational movement in the conveying direction of the first pre-product 1 as soon as the edge region 2 of the first pre-product 1 along the conveying direction of the first pre-product 6 is approximately in the same position as the edge 9 (cf. FIG. 2). This translational movement corresponds substantially to the conveying speed of the first pre-product 1, as a result of which the latter and the conveyor table 15 move simultaneously in the conveying plane and simultaneously, with the edge region 2 and the edge 9 in front, press against the second pre-product 6 located in the wrapping position, as illustrated in FIG. 2.

Figure 3:
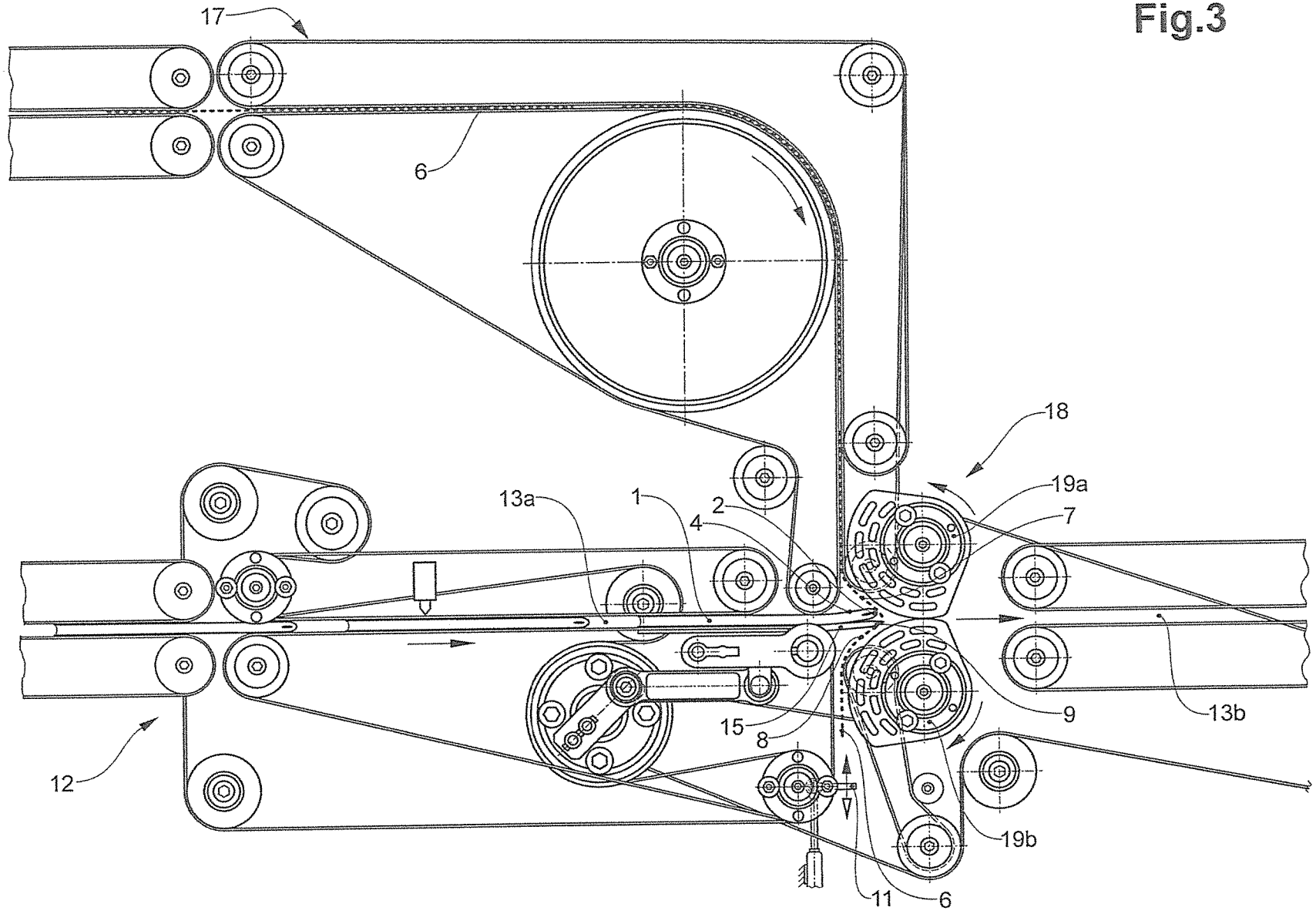
FIG. 3 shows the embodiment of a wrapping device shown in FIG. 1, during operation, at a third consecutive point in time, after the second.

As shown in FIG. 3, a wrapping operation is thus initiated. Since the first pre-product 6 rests on the conveyor table 15, it is supported in the vertical direction in the region of the at least temporary conveyor gap 14. This therefore prevents any bending of the first pre-product 1 in the vertical direction due to the inherent weight thereof. The edge 9 pressing simultaneously with the edge region 2 against the second pre-product 6 likewise prevents the situation whereby the first pre-product 1 is crushed or buckles in the conveying direction. The edge 9 thus aids the operation of wrapping around the second pre-product 6.

Figure 4:
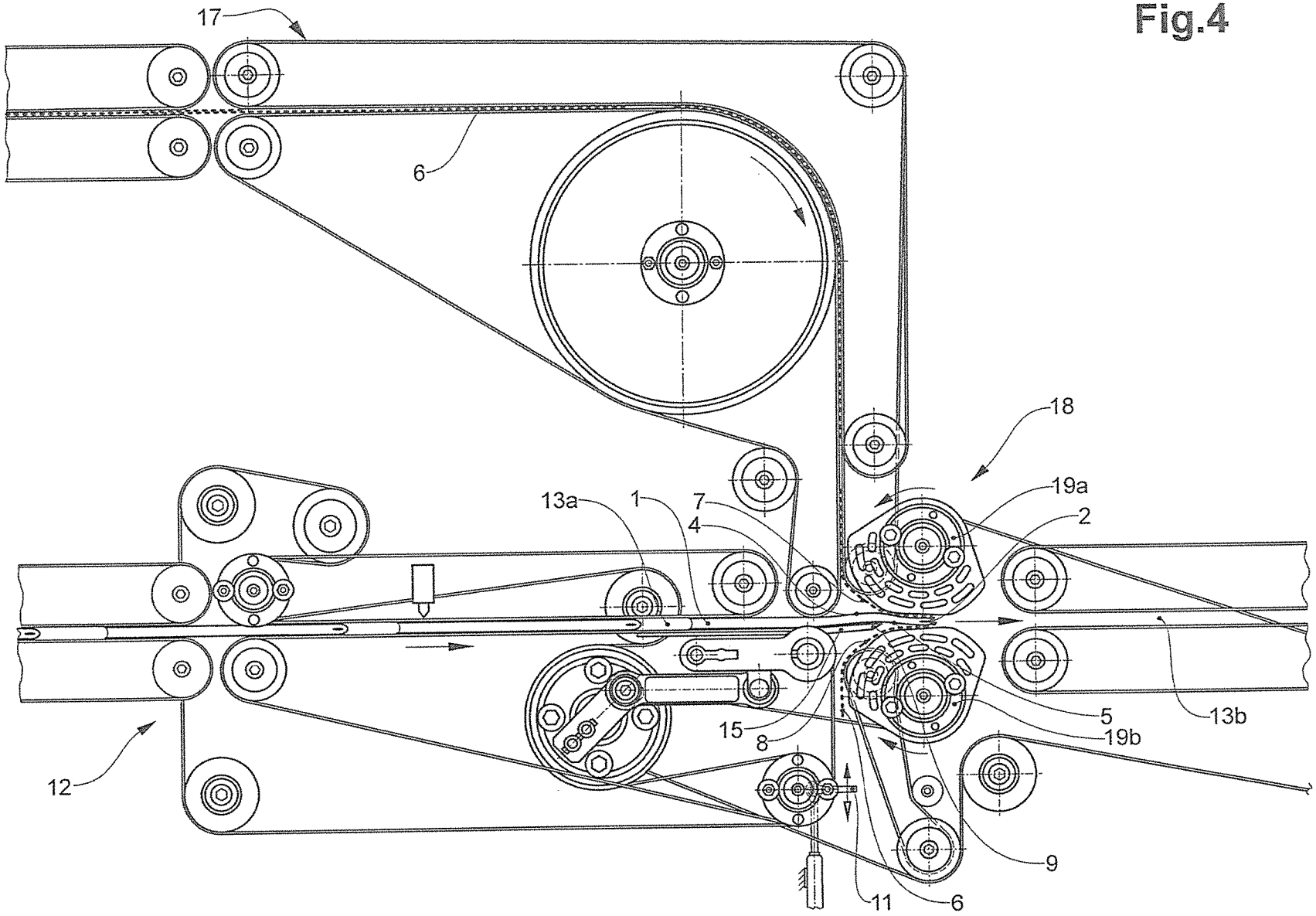
FIG. 4 shows the embodiment of a wrapping device shown in FIG. 1, during operation, at a fourth consecutive point in time, after the third.
Figure 5:
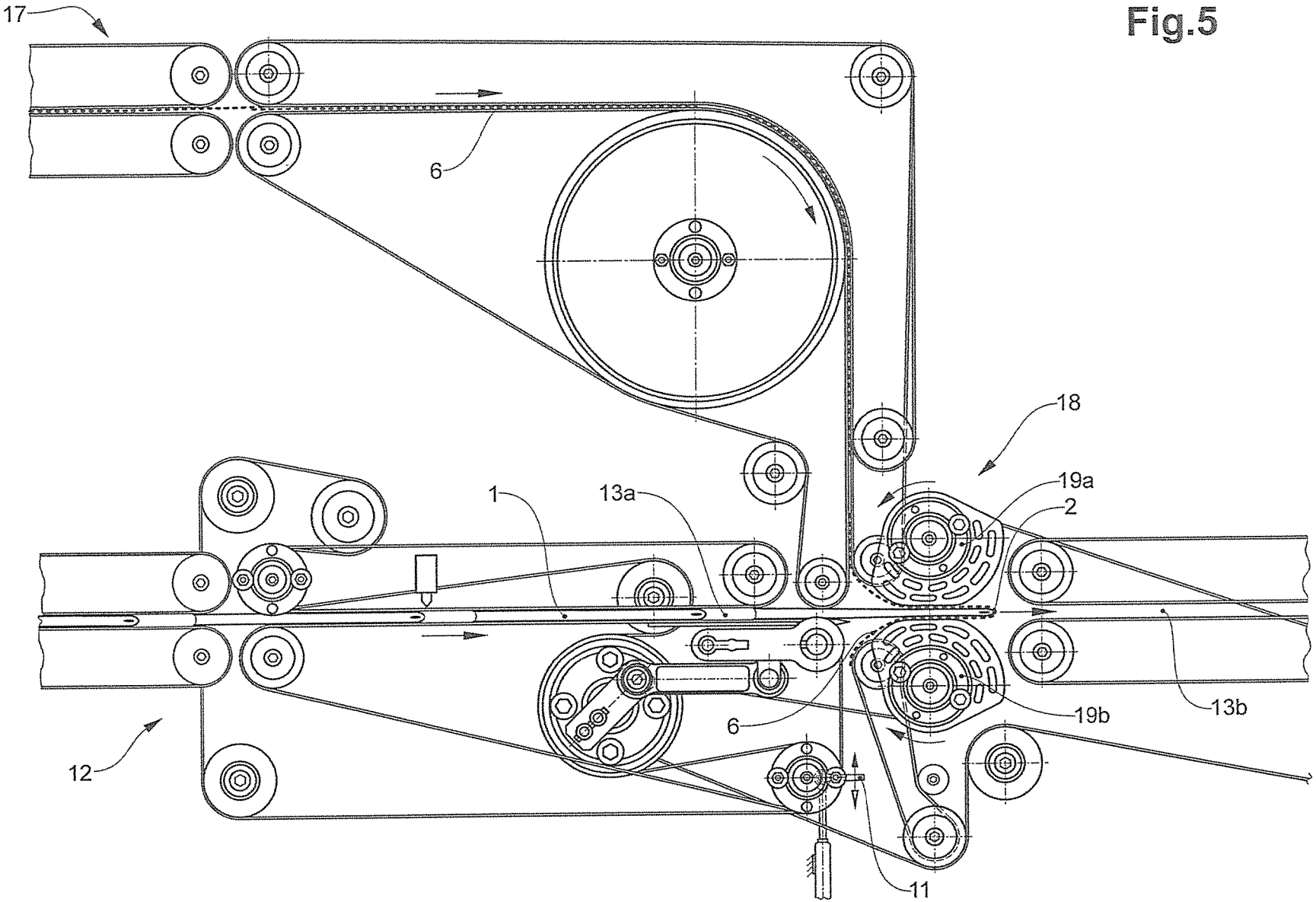
FIG. 5 shows the embodiment of a wrapping device shown in FIG. 1, during operation, at a fifth consecutive point in time, after the fourth.
Figure 6:
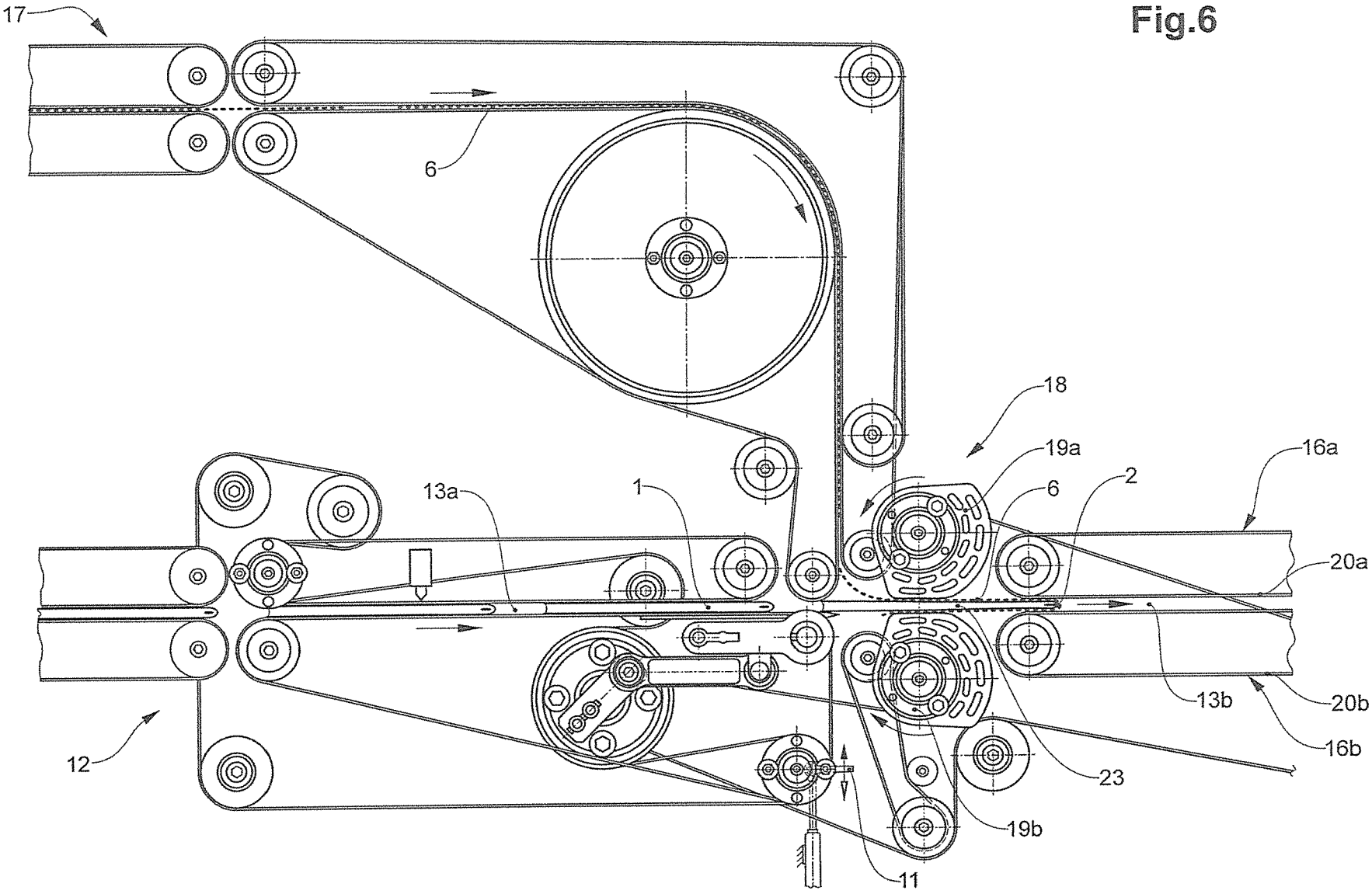
FIG. 6 shows the embodiment of a wrapping device shown in FIG. 1, during operation, at a sixth consecutive point in time, after the fifth.
Figure 7:
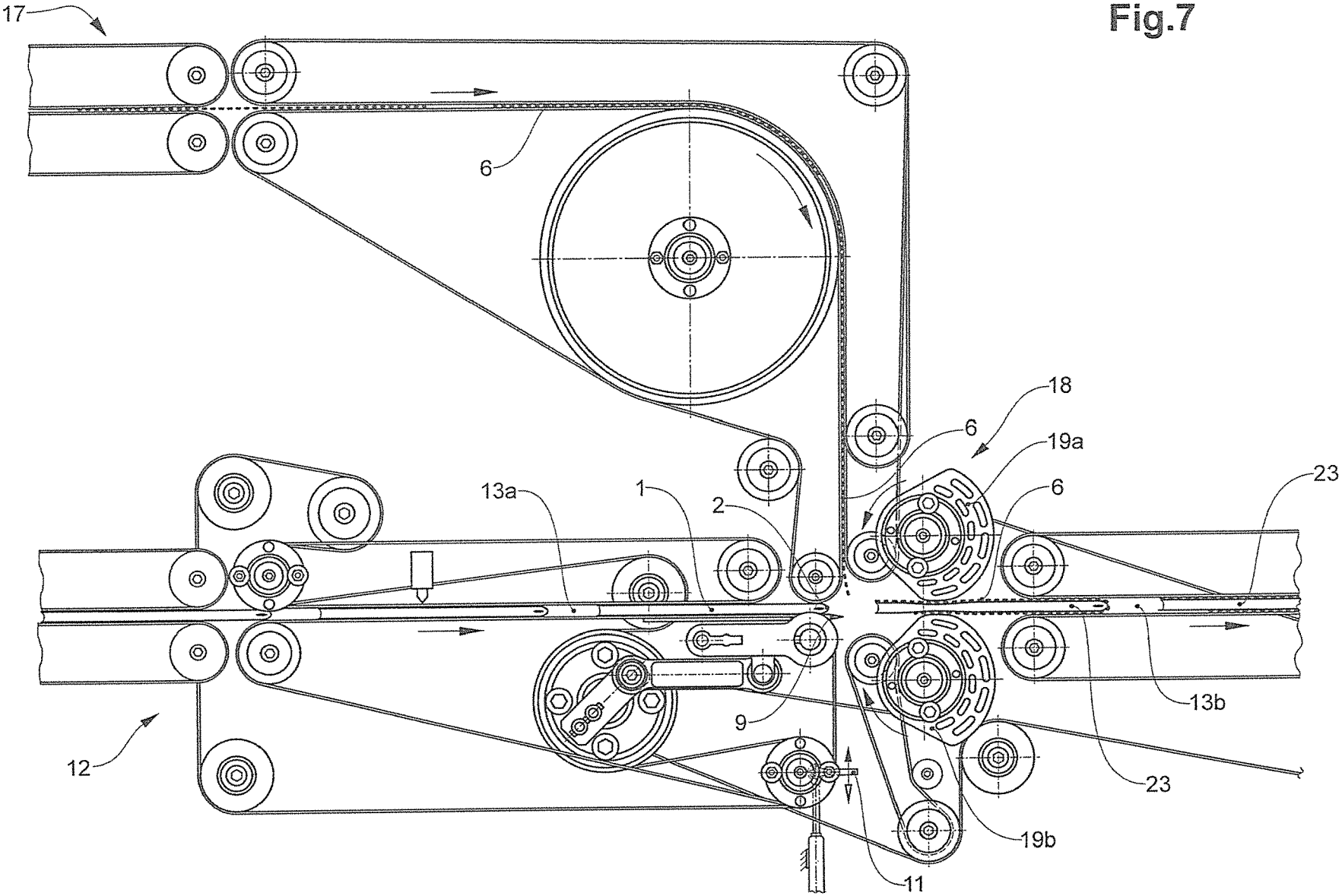
FIG. 7 shows the embodiment of a wrapping device shown in FIG. 1, during operation, at a seventh consecutive point in time, after the sixth.

The device shown in FIGS. 1 to 8 also has a pressing-together device 18 which comprises a pair of rollers 19*a*, 19*b* with axes of rotation arranged parallel to one another and parallel to the edge region 2. The two rollers 19, 19*b* have a region made of foam rubber with a plurality of relatively large internal cavities, as a result of which the stiffness thereof in the radial direction is relatively low, thereby making said rollers compressible in the radial direction. The rollers 19*a*, 19*b* moreover have a radius which is variable in the circumferential direction, as a result of which they could also be referred to as segment rollers. The upper illustrated roller 19*a* rotates in the anticlockwise direction, whereas the lower roller 19*b* rotates in the clockwise direction (illustrated in each case by curved arrows). These rotational movements are adapted to or synchronized with the movement of a first pre-product 1 located in the at least temporary conveyor gap 14, so that a first sub-area 7 of an outer surface of the second pre-product 6 and a first side 4 of the first pre-product 1 and a second sub-area 8 and a second side 5 of the first pre-product 1, located opposite the first side 4, are pressed against one another, as illustrated in FIG. 4. The rollers 19*a*, 19*b* are moreover designed in such a way that they can convey the first and second pre-product 1, 6 in a temporarily clamped manner, as also illustrated in FIG. 4. During this clamped conveying, the first and second pre-product 1, 6 are further pressed against one another, as shown schematically in FIGS. 5 to 7. The translational movement of the conveyor table 15 is thus adapted to the pressing-together device 18 so that said conveyor table does not become clamped between the rollers 19*a*, 19*b*, as shown in FIG. 4. As shown in FIG. 4, the conveyor table 15 can still continue to temporarily support the first pre-product 1 in the vertical direction while the latter is being conveyed together with the second pre-product 6 in a clamped manner by the pressing-together device 18 to the second transport section 13*b* (illustrated schematically by the arrow). The conveyor table 15 meanwhile returns to the starting position shown in FIG. 5, counter to the conveying direction of the first pre-product 1, in order subsequently (cf. FIG. 7) to convey a subsequent further first pre-product 1 against a further second pre-product 6.

Figure 8:
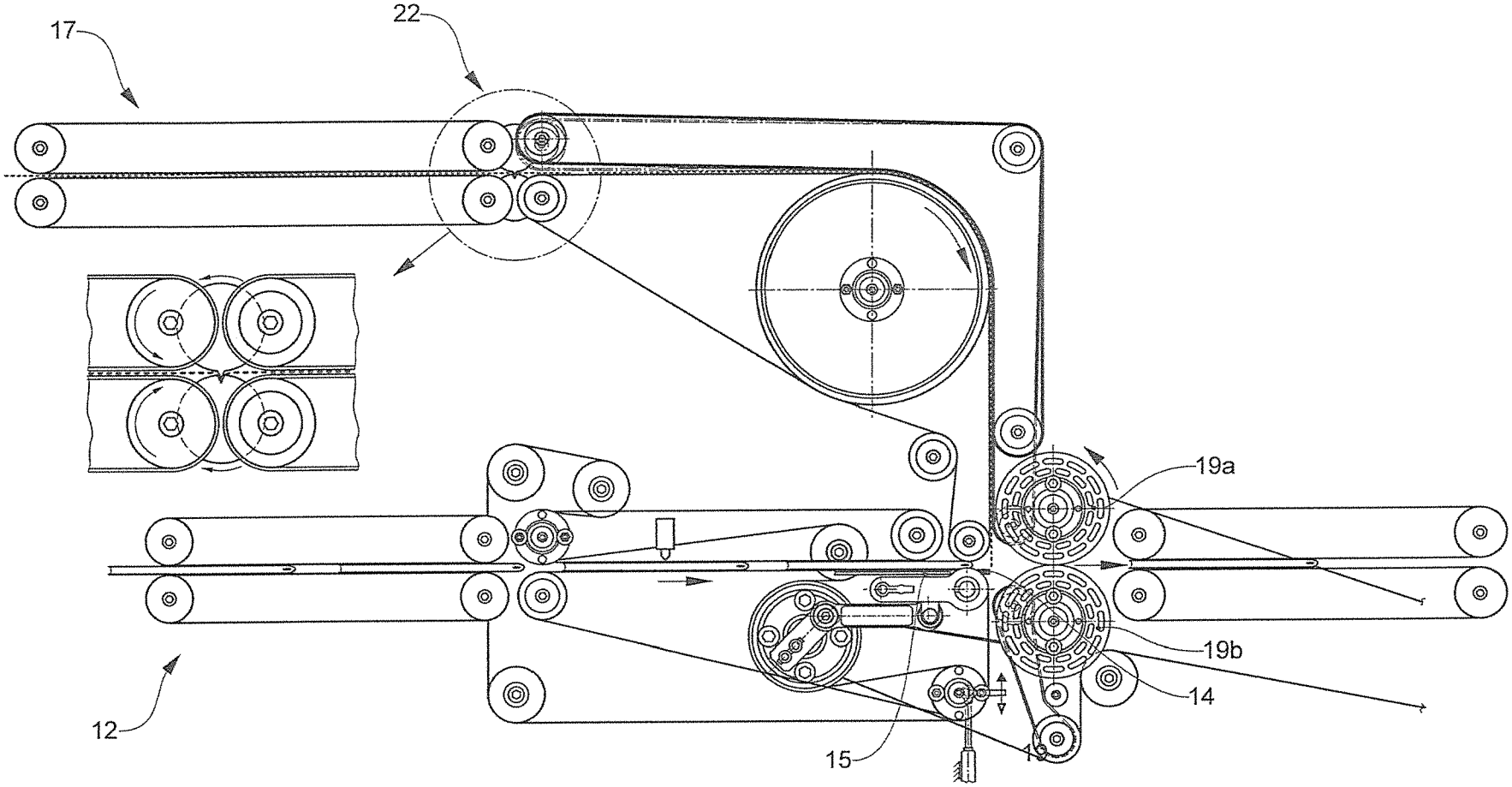
FIG. 8 shows, in a schematic side view, a second exemplary embodiment of a wrapping device.
Figure 9:
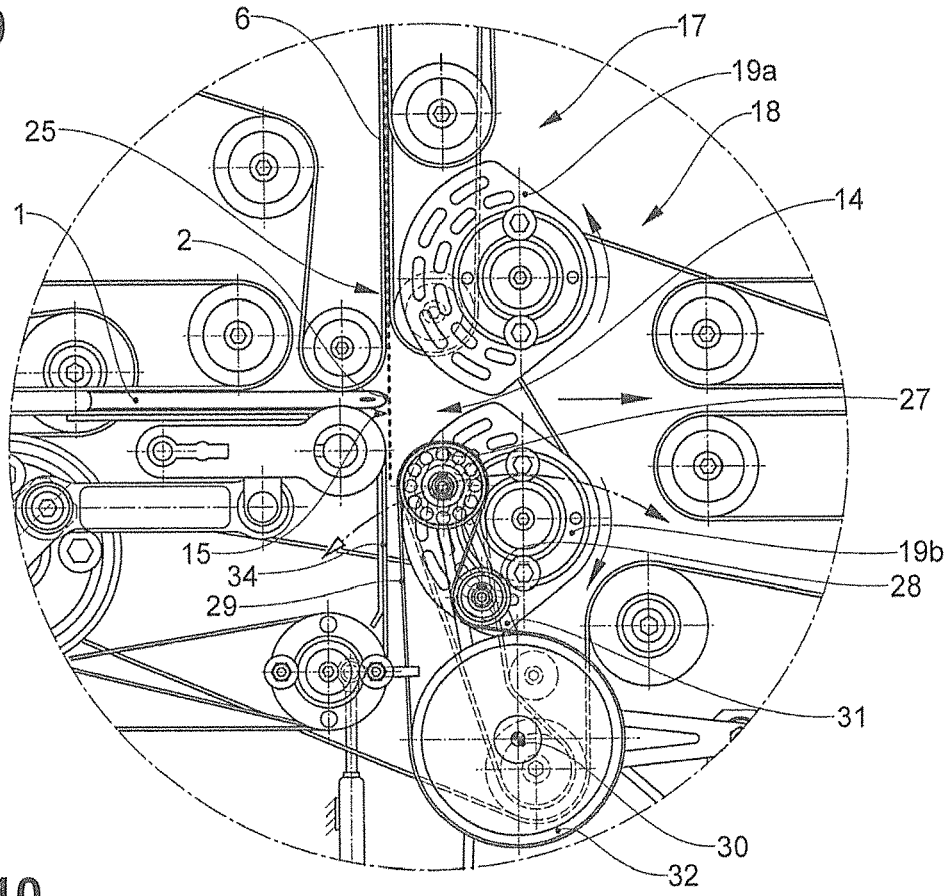
FIG. 9 shows, in a schematic side view, a clamping operation carried out by a clamping device at the time of initiation of the wrapping operation.
Figure 10:
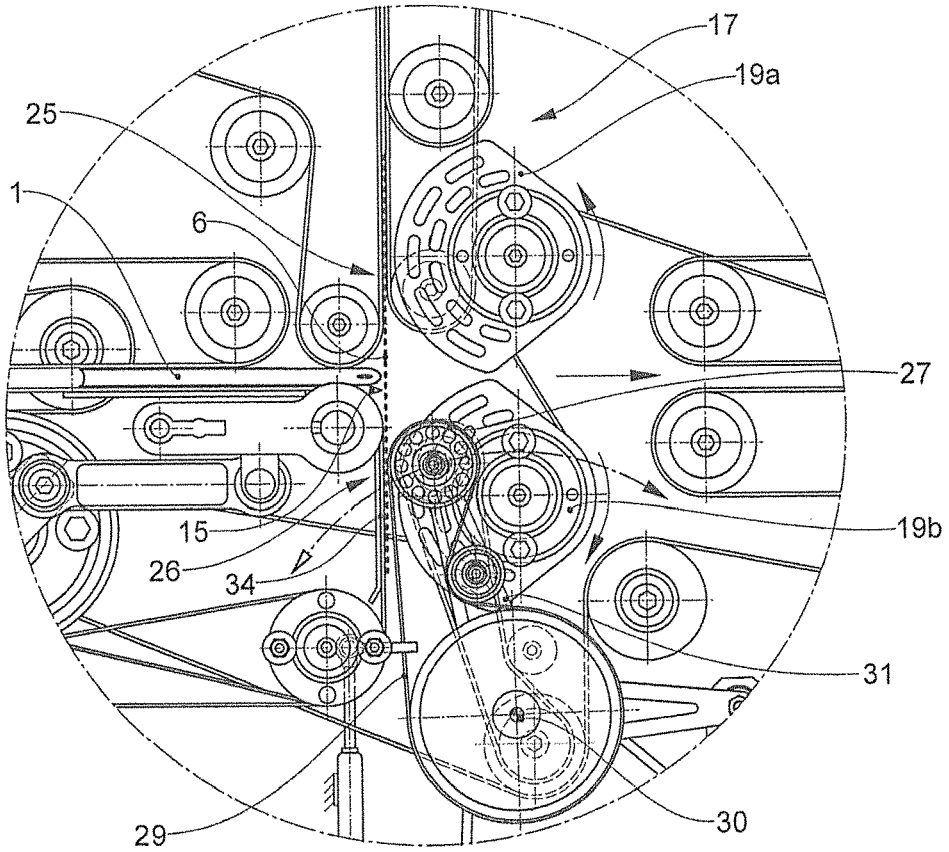
FIG. 10 shows, in a schematic side view, a further clamping operation carried out by a clamping device after the time of initiation of the wrapping operation.

FIG. 8 shows a further embodiment of a device according to the invention. Said device additionally has a scoring device 22 which is arranged in the region of the first conveyor device 17 and which in the illustrated embodiment consists essentially of two rolls rotating in opposite directions, as can be seen in the detail view of the scoring device 22 contained in FIG. 8. The axes of rotation of the two rolls are transverse to the conveying direction of the second pre-products 6, which are passed through between the rolls and are provided with a score by the latter. To this end, a strip-like raised area is arranged on the upper of the two illustrated rolls and a corresponding depression is arranged on the lower roll. The rolls could also be conversely constructed. Also shown in FIG. 8 is a pressing-together device 18 which, in a manner differing from FIGS. 1-7, comprises rollers 19*a*, 19*b* of constant radius. Instead of rollers 19*a*, 19*b*, rolls having such a constant radius may also be used. Such rollers (or rolls) can also be used in devices without a scoring device 22, for example in the device shown in FIGS. 1 to 7.

FIGS. 9 to 12 schematically show an embodiment of a clamping device which can temporarily clamp the second pre-product 6 at a first and a second clamping region 25, 26 before and during the wrapping operation. As a result, it is possible if necessary to prevent the second pre-product 6 from sliding in an uncontrolled manner over the edge region 2 of the first pre-product 1 at the time of initiation of the wrapping operation, as a result of which the wrapping result would be impaired. Such a behavior, which is usually undesirable, may occur for example if a portion of the second pre-product is still being conveyed in a clamped manner by the first conveyor device 17 at the time of initiation of the wrapping operation, that is to say is restricted in its movement, and another part is free in the at least temporary conveyor gap 14. The illustrated embodiment of a clamping device comprises a clamping roller 27 which is connected to a brake roller 32 via a belt 29. The belt 29 is kept in the tensioned state by a tensioning roller 28. The clamping roller 27 is mounted by way of a pivoting arm 31 in such a way as to be able to pivot about a pivot axis 30, as illustrated by the curved arrows.

Figure 11:
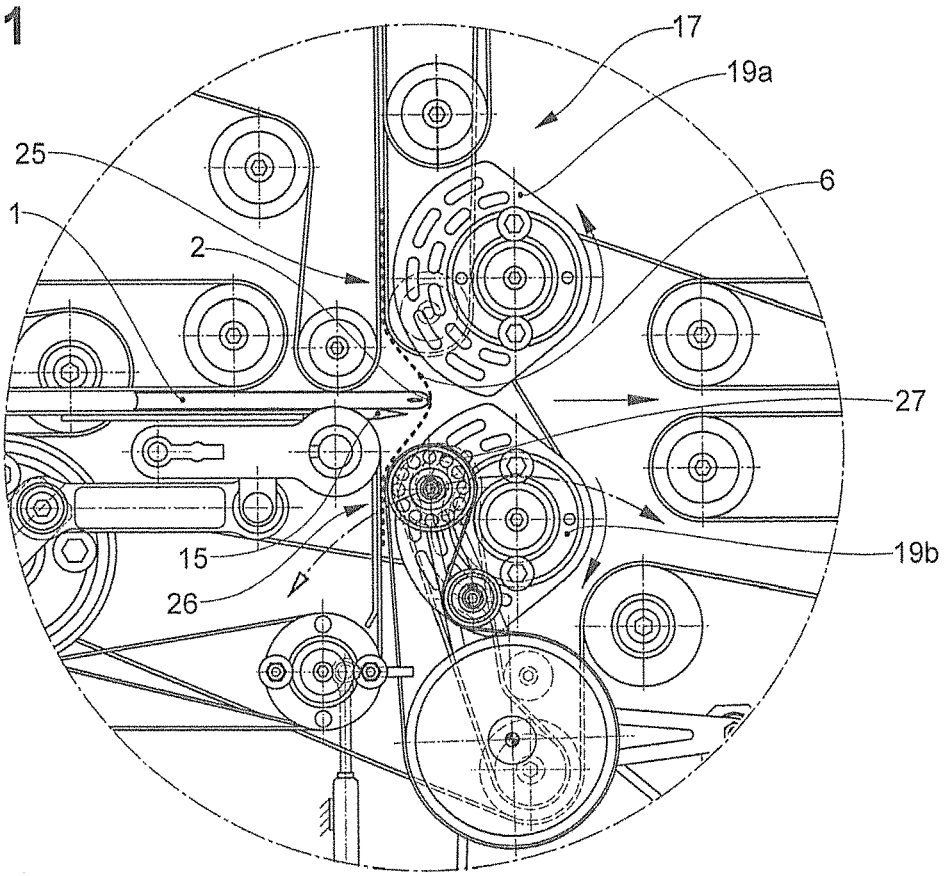
FIG. 11 shows, in a schematic side view, a further clamping operation carried out by a clamping device after the time of initiation of the wrapping operation.
Figure 12:
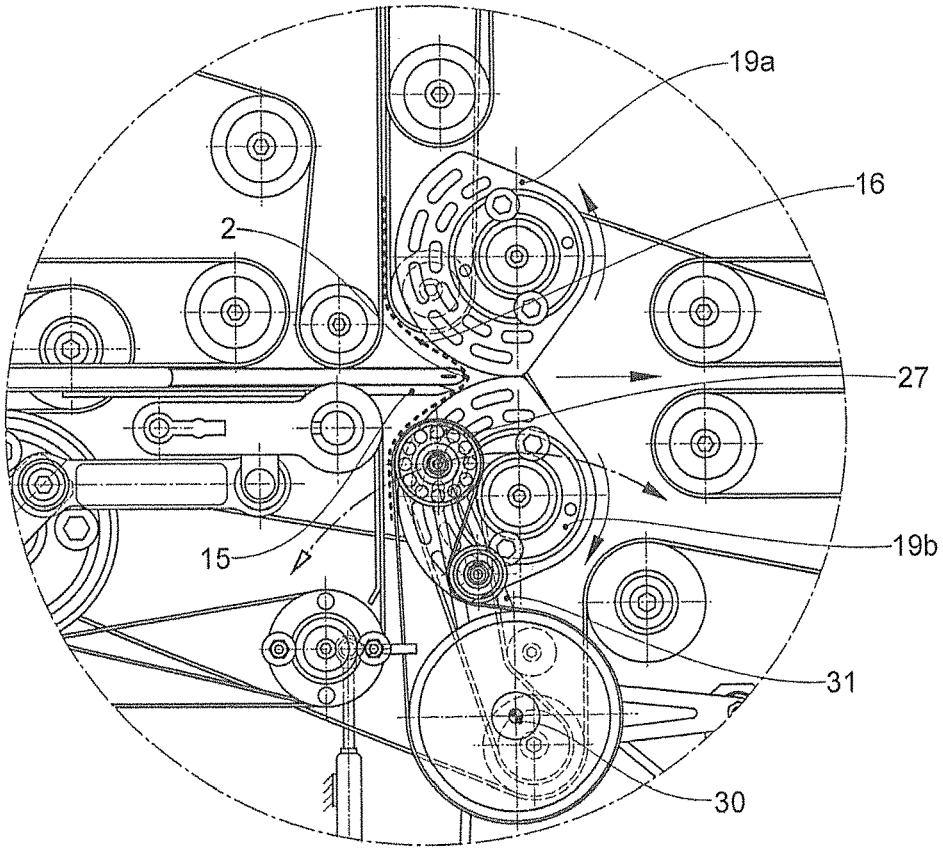
FIG. 12 shows, in a schematic side view, a further clamping operation carried out by a clamping device after the time of initiation of the wrapping operation.

As soon as the second pre-product 6 is located in the wrapping position (cf. FIG. 10), the pivot arm 31 is rotated about the pivot axis in the anticlockwise direction, as a result of which the clamping roller 27 presses the second pre-product 6 in a second clamping region 26 against a counter-bearing 34 and thus clamps the second pre-product 6. At the same time, the second pre-product 6 is clamped in a first clamping region 25 before the first conveyor device 17. By virtue of the clamping in the first and second clamping region 25, 26, both the part of the second pre-product 6 located above the edge region 2 and the part thereof located below said edge region are held with a certain force. As a result, a sliding of the second pre-product 6 over the edge region 2 of the first pre-product 1 during the initiation of the wrapping operation shown in FIG. 11 is prevented.

As soon as the first and second pre-product 1, 6 are clamped by the rollers 19*a*, 19*b* of the pressing-together device 18 (cf. FIG. 12), the pivot arm 31 with the clamping roller 27 pivots back in the clockwise direction away from the second clamping region 26, as a result of which the second pre-product 6 is no longer clamped there. A sliding movement between the first and second pre-product 1, 6 is at this point in time prevented by the pressing-together device 18.

Figure 13:
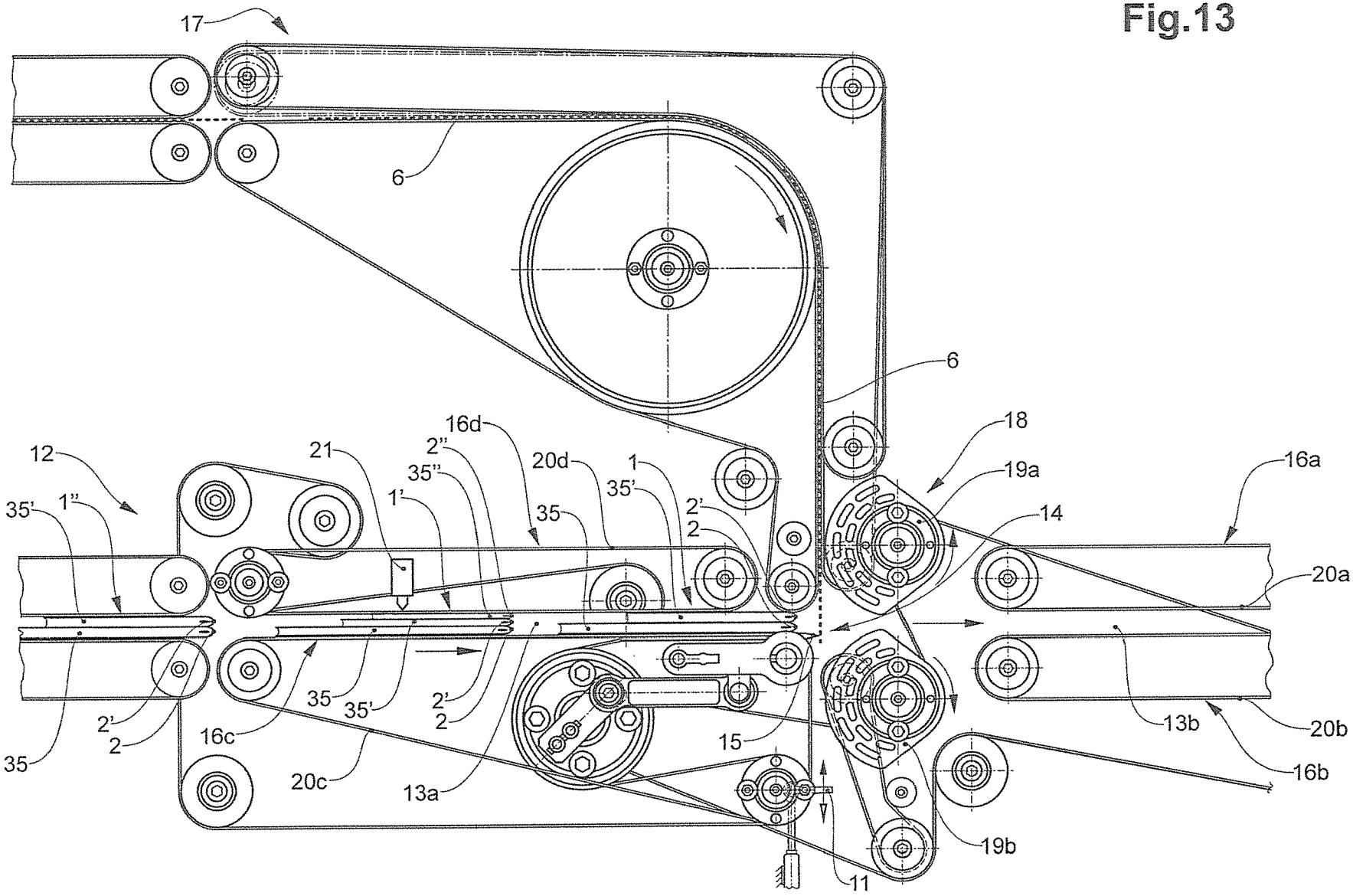
FIG. 13 shows, in a schematic side view, a further embodiment of a method according to the invention.
Figure 14:
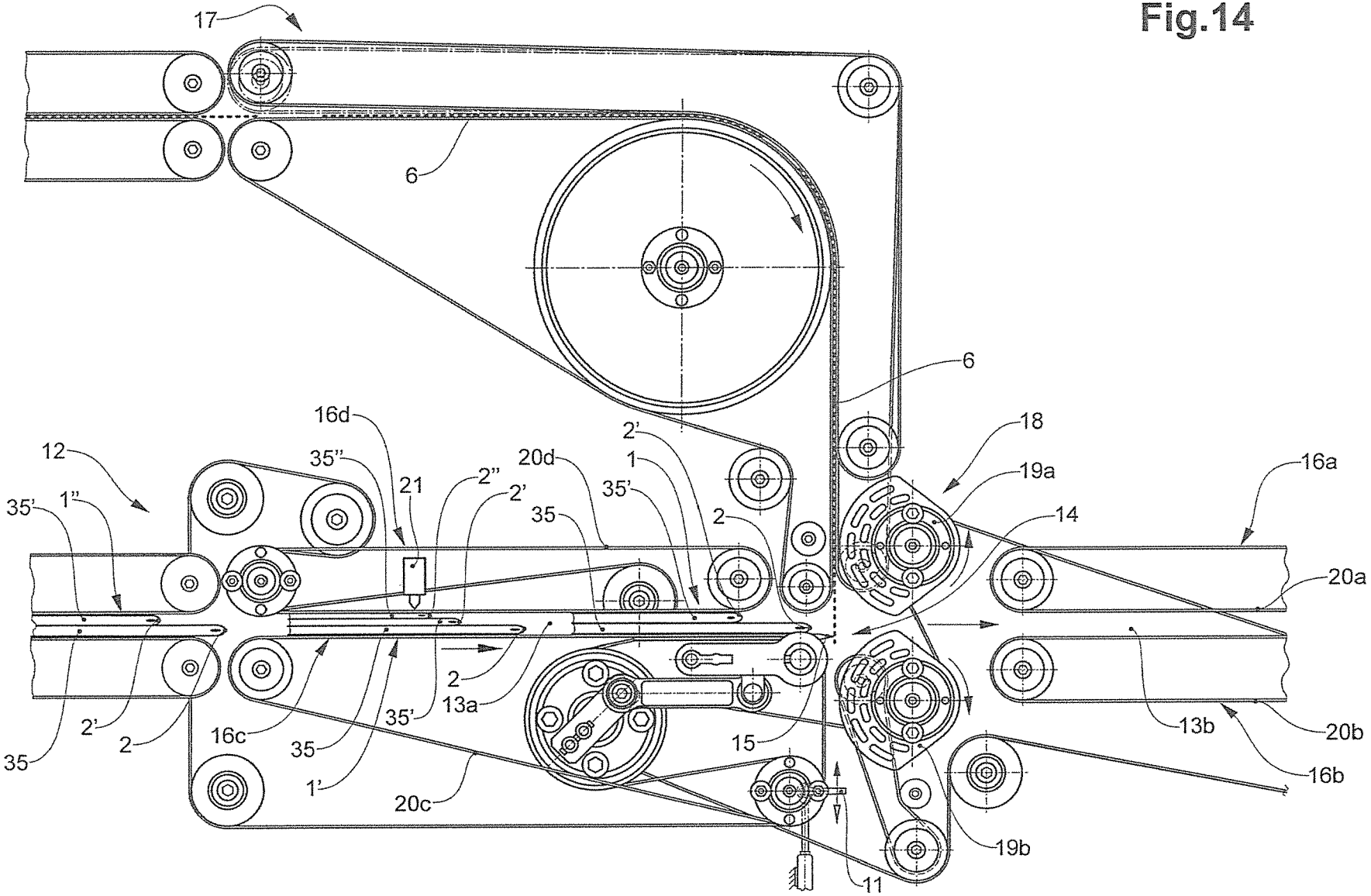
FIG. 14 shows, in a schematic side view, a further embodiment of a method according to the invention.

FIGS. 13 and 14 show a device according to the invention for carrying out a method according to the invention using first pre-products 1, 1" which are in each case stacks of different printed products 35, 35', 35".

The (leading) stacked first pre-product 1 shown on the right in FIG. 13 is formed of a lower large printed product 35 and an upper medium-sized printed product 35'. The printed products 35, 35' each have a fold (or spine) 2, 2' and are arranged in a stacked manner in such a way that the folds/spines 2, 2' thereof form a stack edge which represents the edge region 2, 2'. The middle stacked first pre-product 1' shown in FIG. 13 is formed of a lower large printed product 35, a middle medium-sized printed product 35' and an upper small printed product 35". The printed products 35, 35', 35" each have a fold (or spine) 2, 2', 2" and are likewise arranged in a stacked manner in such a way that the spines 2, 2', 2" thereof form a stack edge which represents the edge region 2, 2', 2". The stacked first pre-product 1" shown on the left in FIG. 13 is constructed in the same way as the first pre-product 1 shown on the right. Pre-products 1, 1', 1" constructed as shown in FIG. 13 enable a secure wrapping of a second pre-product 6 around in each case all of the printed products 35, 35', 35" to be wrapped. As a result, it is possible to avoid the situation whereby individual printed products 35, 35', 35" fall out of the collection when a resulting collection is gripped by hand.

The (leading) stacked first pre-product 1 shown on the right in FIG. 14 is likewise formed of a lower large printed product 35 and an upper medium-sized printed product 35'. The printed products 35, 35' likewise each have a fold (or spine) 2, 2', but are arranged in a stacked manner in such a way that the flowers thereof form a stack edge. The edge region 2 is formed by the spine 2 of the lower printed product 35. The illustrated middle stacked first pre-product 1' is likewise formed of a lower large printed product 35, a middle medium-sized printed product 35' and an upper small printed product 35". Here, too, the printed products 35, 35', 35" are arranged in a stacked manner in such a way that the flowers thereof form a stack edge. However, the edge region 2 is formed by the spine 2 of the lower printed product 35. The stacked first pre-product 1" shown on the left in FIG. 14 is once again constructed in the same way as the first pre-product 1 shown on the right. A method using such stacked first pre-products 1, 1', 1" (as shown in FIG. 14) may be advantageous in order to be able to wrap pre-products 1, 1', 1" having a relatively large total thickness (or large maximum stack height). Since such first pre-products 1, 1', 1" have a reduced thickness (or height) in the edge region 2, wrapping is simplified. Moreover, second pre-products 6 which have been wrapped around thus remain better in the wrapped-around state (not shown). At the same time, such collections can have a precisely defined external shape due to the stack edge, which is formed of the flowers, and the wrapped-around second pre-product.

Figure 15:
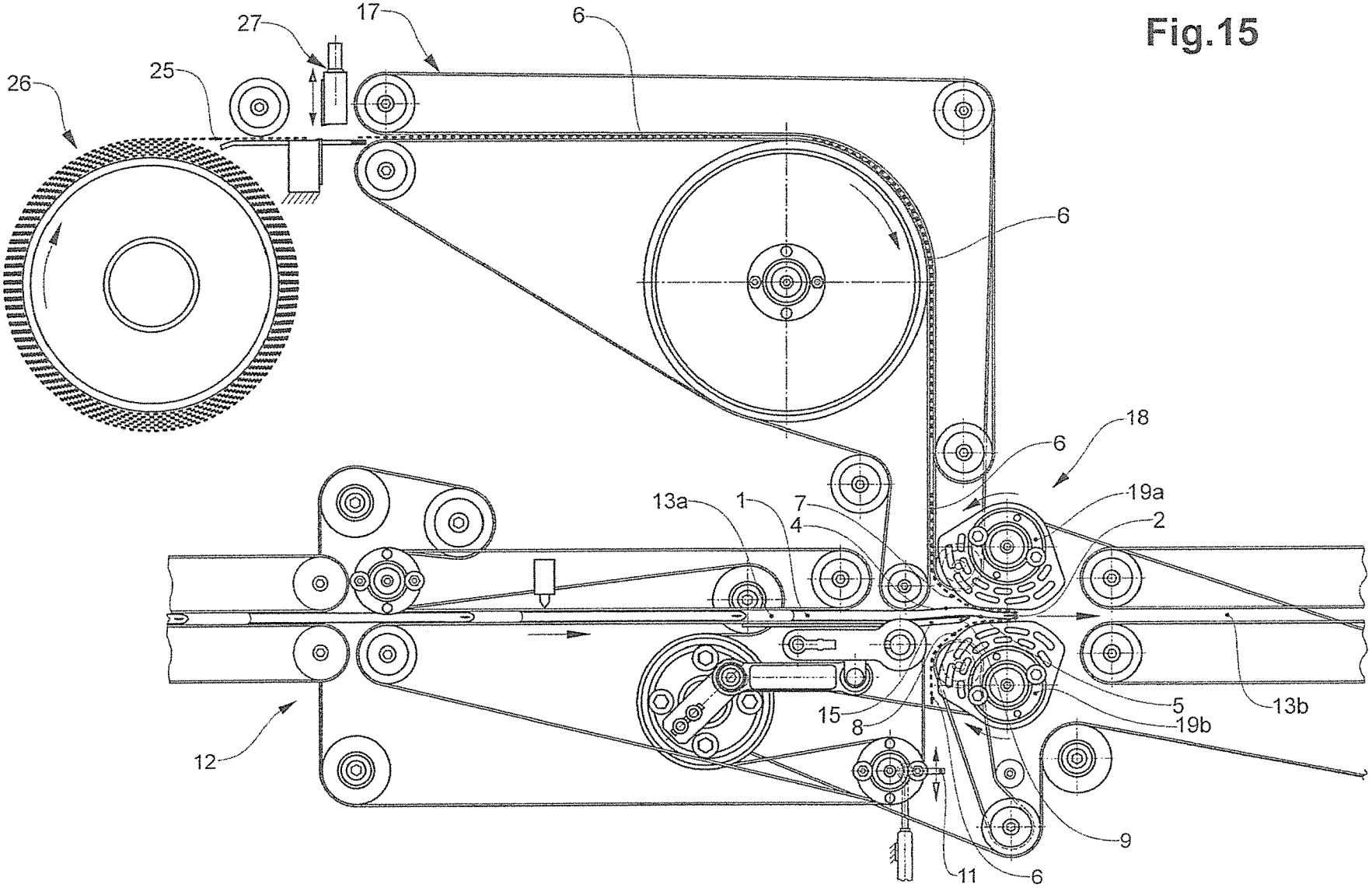
FIG. 15 shows, in a schematic side view, a further embodiment of a device for carrying out a method according to the invention.

FIG. 15 shows a further embodiment of a device according to the invention for carrying out a method according to the invention. The second pre-products 6 are in this case provided as sections of a web 25. This web 25 has been printed in an earlier printing process (not shown) and then wound onto a roll 26. In the illustrated device, this roll 26 is assigned to the first conveyor section 17. The web 25 is unwound from the roll 26, and then the second pre-products 3 are cut from the web 25 by a cutting device 27 and conveyed via the conveyor section 17 into the wrapping position.

Figure 16:
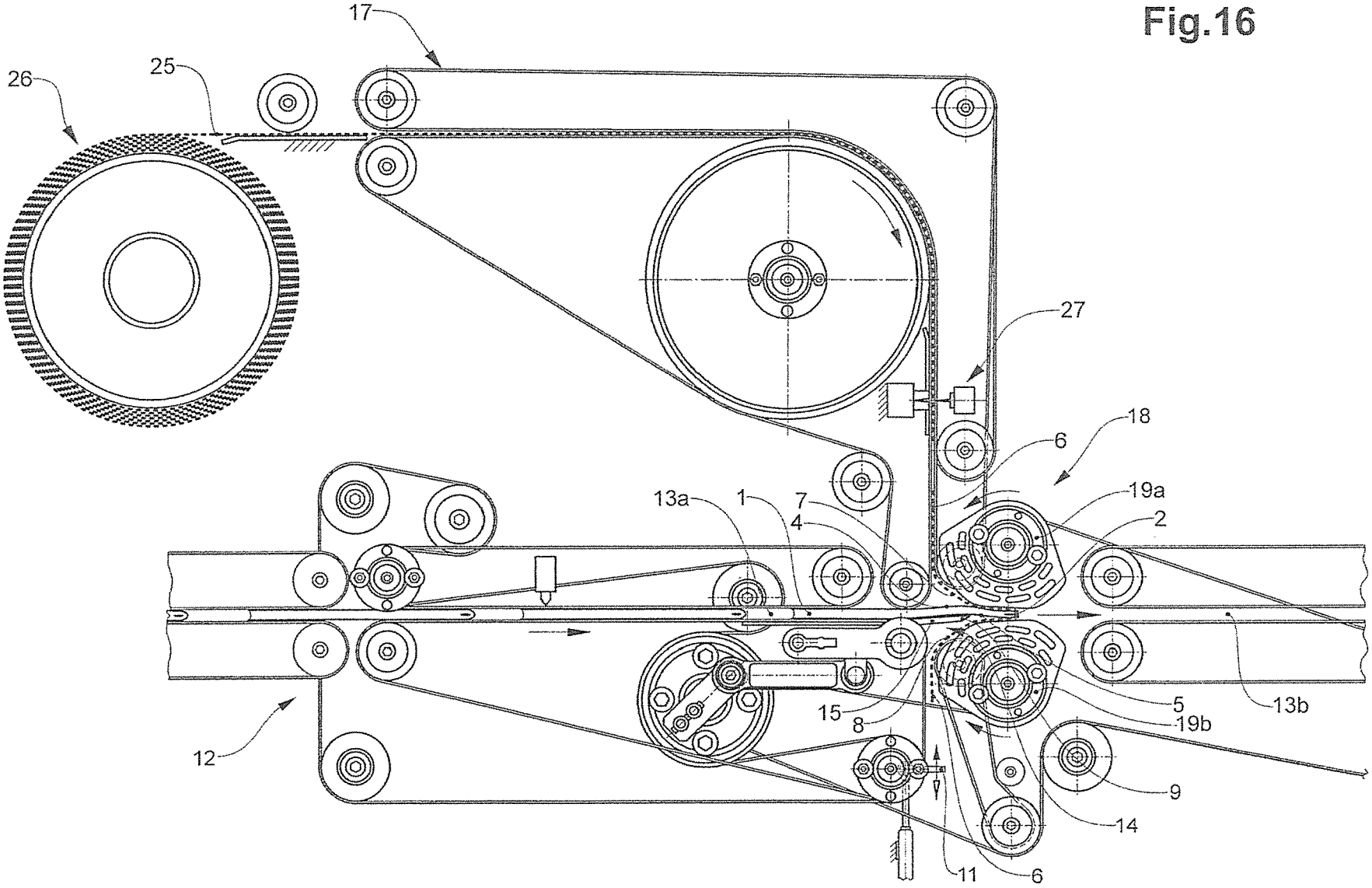
FIG. 16 shows, in a schematic side view, a further embodiment of a device for carrying out a method according to the invention.

FIG. 16 shows another embodiment of a device according to the invention for carrying out a method according to the invention, in which the second pre-products 6, as in the device shown in FIG. 15, are likewise provided as sections of a web 25 on a roll 26. In contrast to the device shown in FIG. 15, however, here the second pre-products 6 are cut from the web 25 by a cutting device 27 only when they are already in the wrapping position or are located at least partially in the conveyor gap 14.

It is claimed:

1. A device for carrying out a method for producing a collection of pre-products by wrapping a second pre-product around a first pre-product, comprising the steps: a. providing a first pre-product, which has an edge region; b. providing a second pre-product; c. conveying the second pre-product into a wrapping position; d. conveying the first pre-product, with the edge region in front, against the second pre-product located in the wrapping position, as a result of which a wrapping operation is initiated on the second pre-product;

said device comprising:

a first conveyor device for the second pre-product, which conveys the second pre-product into the wrapping position; and a second conveyor device for the first pre-product, wherein the second conveyor device includes a conveyor table which conveys the first pre-product, with an edge region in front, against the second pre-product located in the wrapping position in order to initiate the wrapping operation.

2. The device according to claim 1, wherein the second conveyor device comprises at least two transport sections which are located in one plane and between which an at least temporary conveyor gap is left free, in which the second pre-product (6) is held in the wrapping position.

3. The device according to claim 2, wherein the wrapping position extends through the at least temporary conveyor gap.

4. The device according to claim 2, wherein the transport sections comprise belt conveyors.

5. The device according to claim 4, wherein the transport sections of the second conveyor device each have belt conveyor systems formed of two belt conveyors arranged at a distance from one another perpendicular to the one plane in which the transport sections of the second conveyor device are located, and the first and/or second pre-products are transported in a manner clamped between the belts of the two belt conveyors.

6. The device according to claim 1, wherein the device includes a pressing-together device, in which a first sub-area of an outer surface of the second pre-product and a first side of the first pre-product and a second sub-area of the outer surface of the second pre-product and a second side of the first pre-product, located opposite the first side, are pressed against one another.

7. The device according to claim 6, wherein the pressing-together device comprises a roller pair which adjoins the at least temporary conveyor gap and which conveys the first and second pre-product in a temporarily clamped manner.

8. The device according to claim 1, wherein the conveyor table is connected to a drive which enables a recurring translational movement of the conveyor table in the conveying direction of the first pre-product.

9. The device according to claim 1, wherein the conveyor table has an edge which aids the operation of wrapping around the second pre-product.

10. The device according to claim 1, wherein the first conveyor device is assigned a stop which temporarily holds the second pre-product in the wrapping position.

11. The device according to claim 1, wherein the second pre-product is held in a wrapping position which is substantially perpendicular relative to the conveying plane of the first conveyor device.

12. The device according to claim 1, wherein the device includes a moistening device for at least partially moistening the second pre-product prior to the initiation of the wrapping operation.

13. The device according to claim 1, wherein the device includes a scoring device for scoring the second pre-product.

14. The device according to claim 1, wherein the first conveyor device is assigned means for providing a paper or film web.

15. The device according to claim 14, wherein the first conveyor device is assigned a cutting device for cutting the second pre-product from the paper or film web.

16. The device according to claim 1, wherein the cutting device is arranged in such a way that the second pre-product is cut from the paper or film web before said second pre-product is located in the conveyor gap.

17. The device according to claim 1, wherein the cutting device is arranged in such a way that the second pre-product is cut from the paper or film web when said second pre-product is located at least partially in the conveyor gap.

18. A method for producing a collection of pre-products by wrapping a second pre-product around a first pre-product with the device of claim 1, comprising the steps:

a. providing the first pre-product, which has the edge region;

b. providing the second pre-product;

c. conveying the second pre-product via the first conveyor device into the wrapping position;

d. conveying the first pre-product, with the edge region in front, against the second pre-product located in the wrapping position via the second conveyor device, as a result of which a wrapping operation is initiated on the second pre-product.

19. The method according to claim 18, wherein the first pre-product is conveyed, at least with a sub-area resting on the conveyor table, against the second pre-product located in the wrapping position.

20. The method according to claim 18, wherein the conveyor table actively aids the wrapping operation.

21. The method according to claim 18, wherein the second pre-product is provided as a section of a paper or film web.

22. The method according to claim 21, wherein the paper or film web is unwound from a roll.

23. The method according to claim 21, wherein the paper or film web is processed between the roll and a site at which the second pre-product is located in the wrapping position.

24. The method according to claim 18, wherein, in an upstream method step, N individual printed products are provided, the first pre-product is formed of N−x (x=1, 2, 3 . . . ) of the N individual printed products and the second pre-product is formed of the x remaining individual printed products.

25. The method according to claim 24, wherein x=1.

26. The method according to claim 18, wherein, after the initiation of the wrapping operation, the first pre-product and the second pre-product are moved through a pressing-together device, in which a first sub-area of an outer surface of the second pre-product and a first side of the first pre-product and a second sub-area of the outer surface of the second pre-product and a second side of the first pre-product are pressed against one another.

27. The method according to claim 18, wherein the first pre-product is conveyed in a conveying plane.

28. The method according to claim 27, wherein the second pre-product, at the time of initiation of the wrapping operation, is oriented substantially perpendicular to the conveying plane of the first pre-product.

29. The method according to claim 18, wherein the second pre-product is scored prior to the wrapping operation in order to facilitate the wrapping operation.

30. The method according to claim 18, wherein at least part of an outer surface of the second pre-product is moistened prior to the wrapping operation in order to facilitate the wrapping operation.

31. The method according to claim 18, wherein the second pre-product is temporarily held in the wrapping position by a stop.

* * * * *